US010442615B2

(12) United States Patent
Vezina et al.

(10) Patent No.: US 10,442,615 B2
(45) Date of Patent: Oct. 15, 2019

(54) METHOD AND TRANSPORTATION CONTAINER FOR PROTECTING TEMPERATURE SENSITIVE PRODUCTS

(75) Inventors: Jean Vezina, Gainesville, FL (US); Charles Khalil, Miami, FL (US)

(73) Assignee: BLUEYE, LLC, Mango, FL (US)

( * ) Notice: Subject to any disclaimer, the term of this patent is extended or adjusted under 35 U.S.C. 154(b) by 1152 days.

(21) Appl. No.: 12/474,241

(22) Filed: May 28, 2009

(65) Prior Publication Data

US 2009/0293524 A1 Dec. 3, 2009

Related U.S. Application Data

(60) Provisional application No. 61/056,716, filed on May 28, 2008.

(51) Int. Cl.
*B65D 88/74* (2006.01)
*B65D 90/00* (2006.01)

(52) U.S. Cl.
CPC ..... *B65D 88/745* (2013.01); *B65D 88/744* (2013.01); *B65D 90/00* (2013.01);
(Continued)

(58) Field of Classification Search
CPC .... B60H 1/3232; B60H 1/18; B60H 1/00014; B60H 2001/00092; B60H 1/32; B60P 3/20; B60P 3/205; B65D 88/744; B65D 88/745; B65D 90/004; B65D 90/00; B65D 2590/0083; B65D 2590/0066
USPC ..... 62/239, 259.1, 265, 266, 457.1, 457.9, 62/441, 449; 165/41; 454/77, 79, 88, 90, 454/236
See application file for complete search history.

(56) References Cited

U.S. PATENT DOCUMENTS 3,977,208 A * 8/1976 Heighton ..... B65D 88/745 454/118
4,505,126 A * 3/1985 Jones ..... B60P 3/205 280/43.22
(Continued)

FOREIGN PATENT DOCUMENTS

DE 3702792 8/1988
DE 4411922 6/1995
(Continued)

*Primary Examiner* — Edward F Landrum
*Assistant Examiner* — Daniel C Comings
(74) *Attorney, Agent, or Firm* — Saliwanchik, Lloyd & Eisenschenk

(57) ABSTRACT

Embodiments pertain to a method and apparatus for protecting temperature sensitive products during air, ground, or sea transportation. Embodiments relate to a chamber built inside a trailer or sea container where temperature sensitive products are placed to have additional protection against the environmental conditions encountered during the transportation and distribution periods. The dimensions and modularity of the chamber can vary depending on the trailer or sea container the chamber is designed to be used with. This chamber can be preassembled and inserted into the desired trailer or sea container or can be assembled inside the trailer or sea container. The chamber system can include insulated and or non-insulated walls, conveyor system, ventilation system, temperature and asset (trailer or sea container) location tracking.

39 Claims, 15 Drawing Sheets

(52) U.S. Cl.
CPC .... *B65D 90/004* (2013.01); *B65D 2590/0066* (2013.01); *B65D 2590/0083* (2013.01)

(56) References Cited

U.S. PATENT DOCUMENTS

| | | | | |
|---|---|---|---|---|
| 4,606,195 | A | 8/1986 | Winkler | |
| 4,979,431 | A * | 12/1990 | Fujimoto et al. | 454/91 |
| 5,054,295 | A * | 10/1991 | Goulooze | 62/239 |
| 5,319,941 | A * | 6/1994 | Schilling | F25D 17/005 108/51.3 |
| 5,533,275 | A * | 7/1996 | Lawton | 34/433 |
| 6,032,474 | A | 3/2000 | Dale et al. | |
| 6,412,286 | B1 * | 7/2002 | Park et al. | 62/3.6 |
| 6,923,111 | B2 * | 8/2005 | Kiefer | A23B 7/144 62/239 |
| 2004/0020236 | A1 * | 2/2004 | Vince et al. | 62/434 |
| 2007/0163290 | A1 * | 7/2007 | Shin | F25D 17/045 62/408 |
| 2007/0289976 | A1 | 12/2007 | Meyer et al. | |
| 2008/0006041 | A1 * | 1/2008 | Nakata | F25D 17/042 62/131 |
| 2008/0282712 | A1 * | 11/2008 | Franklin | 62/66 |

FOREIGN PATENT DOCUMENTS

| | | |
|---|---|---|
| DE | 102004039372 | 4/2005 |
| DE | 102004050874 | 4/2006 |
| GB | 2408792 | 6/2005 |
| WO | WO 2007119009 A1 * | 10/2007 |

* cited by examiner

METHOD AND TRANSPORTATION CONTAINER FOR PROTECTING TEMPERATURE SENSITIVE PRODUCTS

CROSS REFERENCE TO RELATED APPLICATION

The present application claims the benefit of U.S. Provisional Application Ser. No. 61/056,716, filed May 28, 2008, which is hereby incorporated by reference herein in its entirety, including any figures, tables, or drawings.

BACKGROUND OF INVENTION

Temperature-sensitive products such as pharmaceutical products, blood products, and other biological products are usually required to be maintained in a specific temperature range during transportation and distribution. These products are most often regulated by agencies such as the FDA and need to be kept in a specific temperature range during the entire distribution process. Generally, these products are shipped by air and require a special unit load device (ULD) or complex insulated packages to thermally protect them. Special aircraft containers are insulated and provide refrigeration by means of dry ice or other mechanical devices, that maintain proper temperature in a specified range. However, during ramp transfers, before or after a flight, products transported in and/or on these special ULDs can be exposed to the outside environment for several hours without any added protection and, as a result, can occasionally suffer from temperature abuses (hot or cold).

Air transportation is very expensive and can sometimes provide poor results. The other alternative modes to air transportation are ground and sea. Ground transportation is currently used for inland distribution, but still suffers from poor temperature maintenance as well as poor air distribution. These deficiencies are mainly due to poor air circulation and minimal wall insulation. Sea transportation is not currently used for highly temperature sensitive products, such as pharmaceutical products. This is primarily due to the considerably long amount of time that the sea container is unmonitored and also due the fact that poor thermal protection is offered when the refrigeration unit is not running (in case of a failure of the refrigeration unit or when the refrigeration unit is unplugged for loading/unloading to/from a ship). A lack of refrigeration can be detrimental to the temperature inside a container, which can permanently damage the products. Another problem related to sea transportation is the lack of visibility of the load for many days or weeks. The lack of visibility can disable the shipper's ability to assure the security and the localization of the load, as well as reduce the shipper's ability to proactively alarm the transportation company of any malfunctions of the refrigeration unit.

Accordingly, there is a need for a method and apparatus for protecting temperature sensitive products during air, ground, or sea transportation.

BRIEF SUMMARY

Embodiments of the invention pertain to a method and apparatus for protecting temperature sensitive products during air, ground, or sea transportation. Specific embodiments of the invention relate to a chamber built inside a trailer or sea container where temperature sensitive products are placed to have additional protection against the environmental conditions encountered during the transportation and distribution periods. The dimensions and modularity of the chamber can vary depending on the trailer or sea container the chamber is designed to be used with. This chamber can be preassembled and inserted into the desired trailer or sea container or can be assembled inside the trailer or sea container. The chamber system can include insulated and or non-insulated walls, conveyor system, ventilation system, temperature and asset (trailer or sea container) location tracking. The location tracking can utilize, for example, cellular (GSM) and/or satellite communication, with or without GPS tracking. Each wall of the chamber can be composed of a single material or a combination of dissimilar materials. One or more of the materials in the wall can posses insulating and/or phase changing properties. Different layers of the wall may incorporate different materials.

The chamber system can provide thermal protection to temperature-sensitive products against cold or warm weather. The chamber may have the capabilities of performing below −35 and above 30 degrees Celsius as well as between −35 and 30 Celsius. Embodiments of the chamber system allow creating an inner air gap between the inner walls of the trailer (or sea container) and the exterior walls of the subject chamber. The air exchange inside and outside the chamber can be accomplished via various methods and techniques. The technique and the characteristics of the technique utilized to accomplish the air exchange can vary depending on the size of the chamber, the materials used in constructing the chamber, the physical and chemical characteristics of products transported or distributed, and the packaging system of the products itself. In specific embodiments, the air exchange technique used for the chamber system can allow internal and external air flow based on specific temperature differences along the chamber and in the inner air gap. These characteristics of the chamber system are particularly important once the products are loaded into the chamber due to the fact that the chamber restricts the amount of energy (heat) exchange between the products and the outside environment, providing an almost constant temperature inside the entire load (transported products).

Embodiments incorporate global monitoring of the shipment. Internal temperature can be monitored at different locations in the chamber and transmitted utilizing different modes of communication during part of, or the entire transportation process.

DETAILED DISCLOSURE

Embodiments of the invention relate to a method of transporting cargo and a transportation container having a primary chamber with a primary door. The primary door opens to provide access into the primary chamber from outside the transportation container. The transportation container also has a secondary chamber that is adapted to hold a load to be transported. The secondary chamber has a secondary door. The secondary chamber is enclosed within the primary chamber when the secondary door is closed and the primary door is closed and the secondary door opens to provide access into the secondary chamber from the primary chamber.

A primary passageway allows a primary fluid into the primary chamber. The primary fluid can be, for example, a liquid, a gas, a gas mixture, or a combination thereof, and is preferably air conditioned air. A secondary passageway allows a secondary fluid into the secondary chamber. The secondary fluid can be, for example, a gas, a gas mixture, a liquid, or combination thereof, and is preferably air conditioned air.

The transportation container can incorporate an air conditioner. The air conditioner can supply air conditioned air to the primary chamber through the primary passage way and to the secondary chamber through the secondary passageway. In an embodiment, one or more blowers are used to push the air conditioned air into the primary chamber and the secondary chamber. In a specific embodiment, the secondary chamber can have a separate air conditioner. In further embodiments, air conditioned air can be supplied from a source independent from the transportation container.

Figure 6:
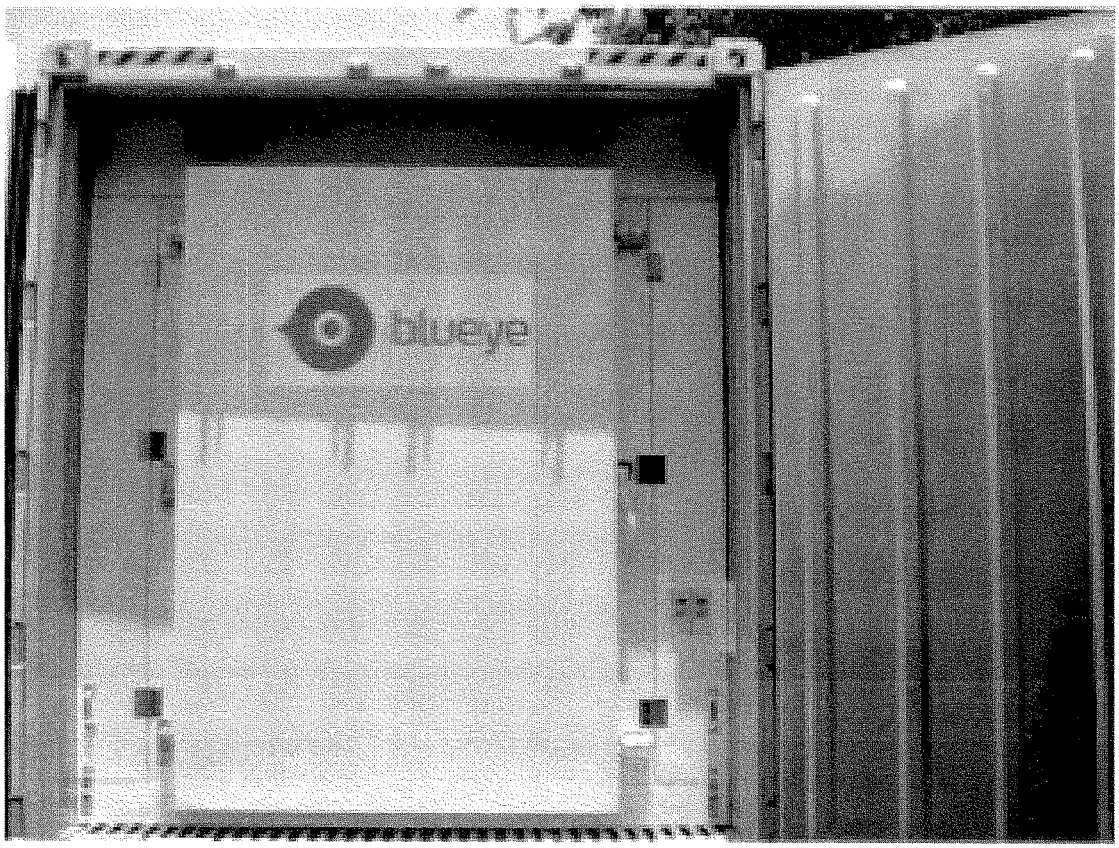
FIG. 6 shows a transportation container with a primary door to the primary chamber open and the secondary door to the secondary chamber closed and a secondary wall that separates the primary chamber into a first portion (behind the secondary wall) and a second portion (in front of the wall and door).
Figure 7:
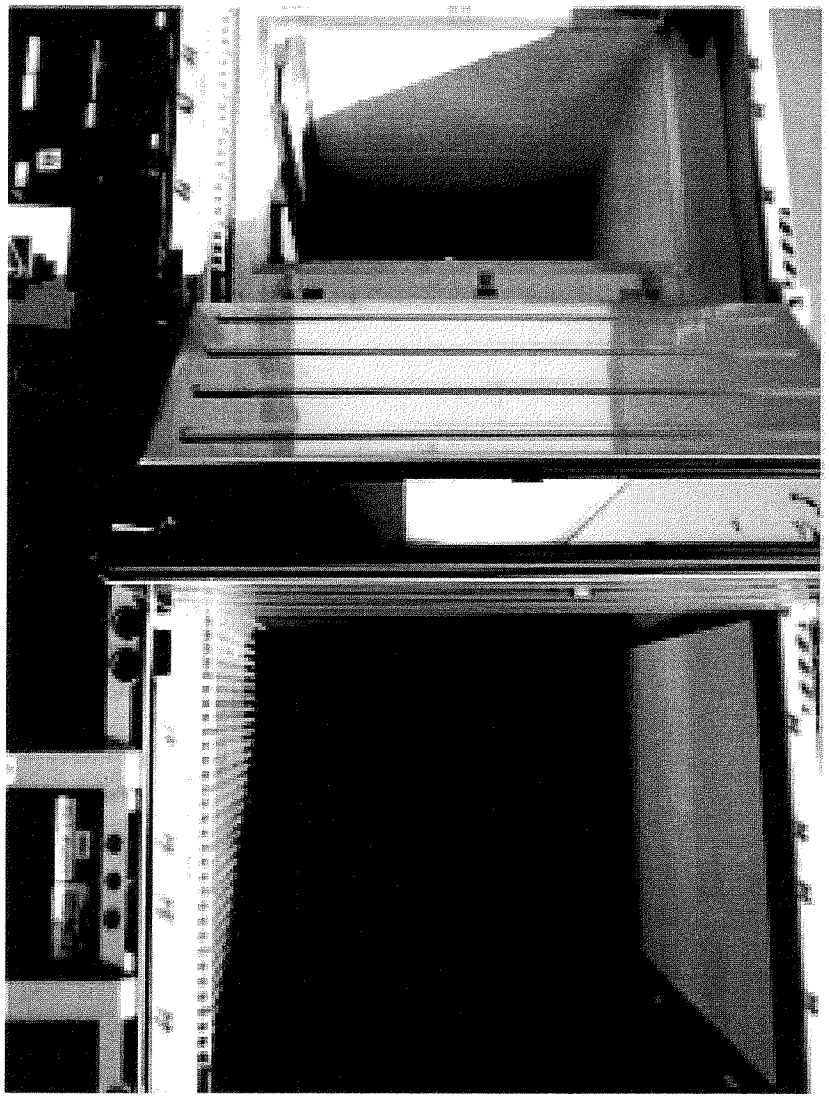
FIG. 7 shows (left) the container of FIG. 6 with the secondary door open and an embodiment of the pallet skid system positioned in the secondary chamber, and shows (right) the transportation container prior to insertion of the secondary structure forming the secondary chamber.

In an embodiment, the primary chamber is formed by a primary structure, where the primary structure includes a primary floor, a primary roof, one or more primary walls, and the primary door. Specific embodiments use known shipping containers to form the primary structure. The secondary chamber can be formed by a secondary structure, where the secondary structure includes the secondary door and at least one secondary wall. In a specific embodiment, the secondary walls can incorporate 3-6 inches of urethane or polyurethane or ¼"-2" of aerogel. The secondary structure can be removable or fixedly attached to the primary structure. The secondary structure can also include at least a portion of the primary floor, at least a portion of the primary roof, and at least a portion of at least one of the one or more primary walls. In this way, parts of the primary structure can be used as part of the secondary structure to form the secondary chamber. One of the secondary walls in combination with the secondary door can separate the primary chamber into a first portion and a second portion. Referring to FIG. 6, an embodiment where the primary chamber can be separated into a first portion and a second portion can be accomplished by having the wall to which the secondary door is attached go all the way to the inside surfaces of the walls of the primary structure. Of course, small openings connecting the first portion and the second portion can be allowed and will just speed up the thermal equilibration between the first portion and the second portion. The secondary door can open to provide access into the secondary chamber from the second portion and the primary door can open to provide access to the second portion from outside the transportation container. In this way, the primary door can be opened while maintaining the temperature of the fluid in the gap between the secondary structure and the primary structure except for the second portion in front of the secondary door. Once the opening from the second portion to the outside is, for example, in communication with a controlled environment for unloading, the secondary door can then be opened.

In a specific embodiment, the secondary structure can include a secondary floor and a secondary roof. In a specific embodiment, the secondary structure can have four secondary walls. In other embodiments, the secondary structure can have one, two, or three walls and can use, for example, portions of three, two or one wall, respectively, of the primary structure. Preferably the primary structure includes four walls. In an embodiment where the secondary structure has four secondary walls and the primary structure has four walls, a gap can be formed between the walls of the primary structure and the walls of the secondary structure. In specific embodiments, the gap can be 1-18 inches thick, 12-18 inches thick, and/or greater than 1 inch thick, to allow sufficient insulating properties. Other dimensions can also be used. The gap is preferably such that little structural contact exists between the primary and secondary structures in order to reduce heat conduction between them. The primary fluid can then be supplied to the gap via the primary passageway and the secondary fluid supplied to the secondary chamber via the secondary passageway. In this way, the gap is the portion of the primary chamber left once the secondary structure is within the primary chamber. Preferably, the primary and secondary fluids are air conditioned.

Figure 1A:
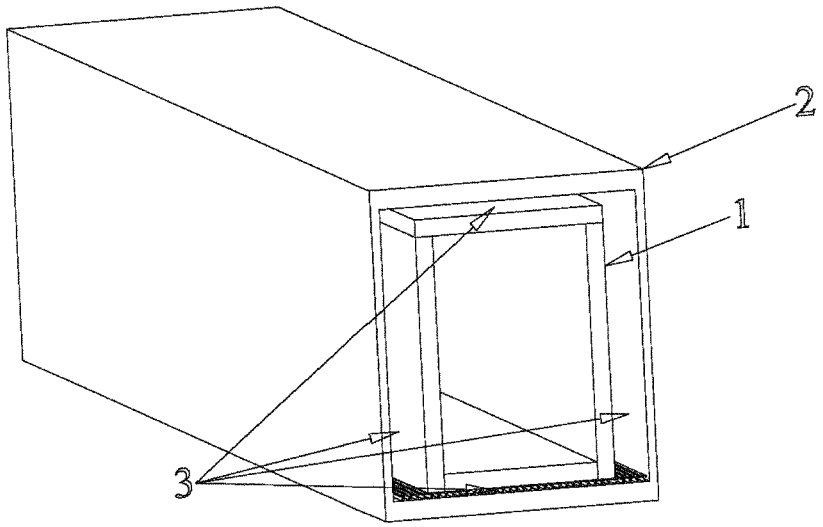
FIGS. 1A and 1B show an embodiment of a chamber system used inside a trailer or sea container where the secondary chamber part 1 has been installed inside the primary trailer or sea container 2 and the air gap part 3 allows air to be exchanged and circulated between the two chambers.
Figure 1B:
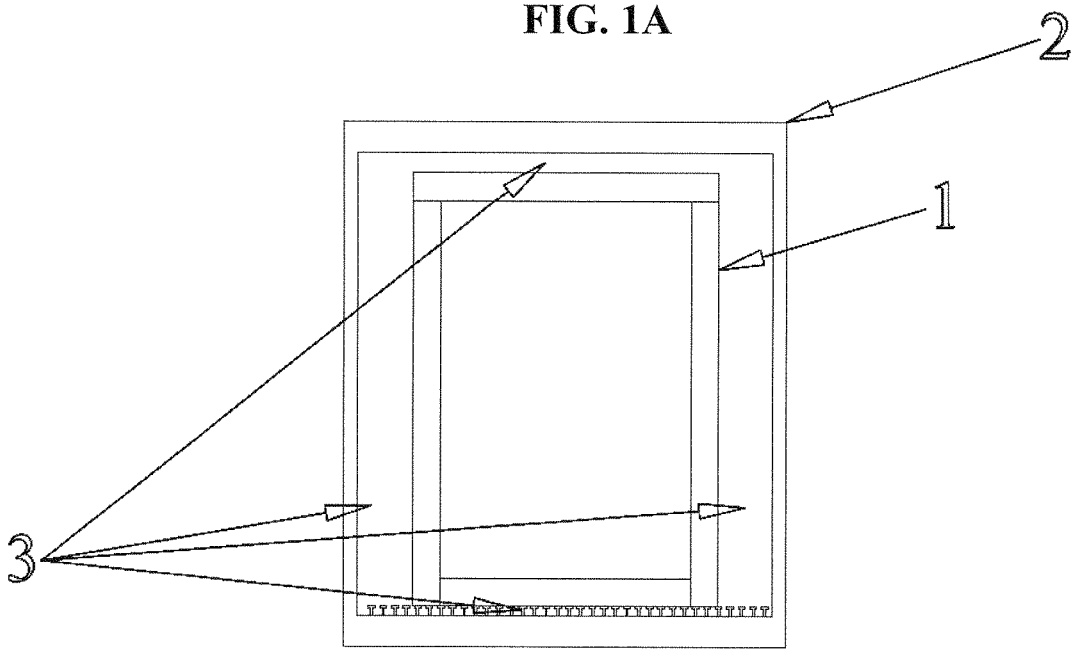
Figure 2A:
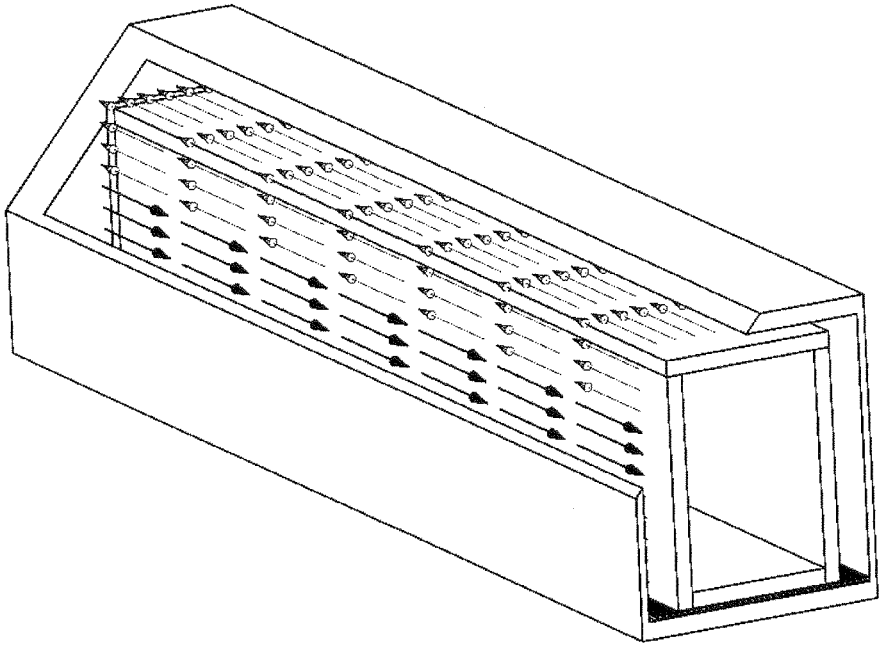
FIG. 2A shows how air is moved in the gap between the two chambers in a sea container.
Figure 2B:
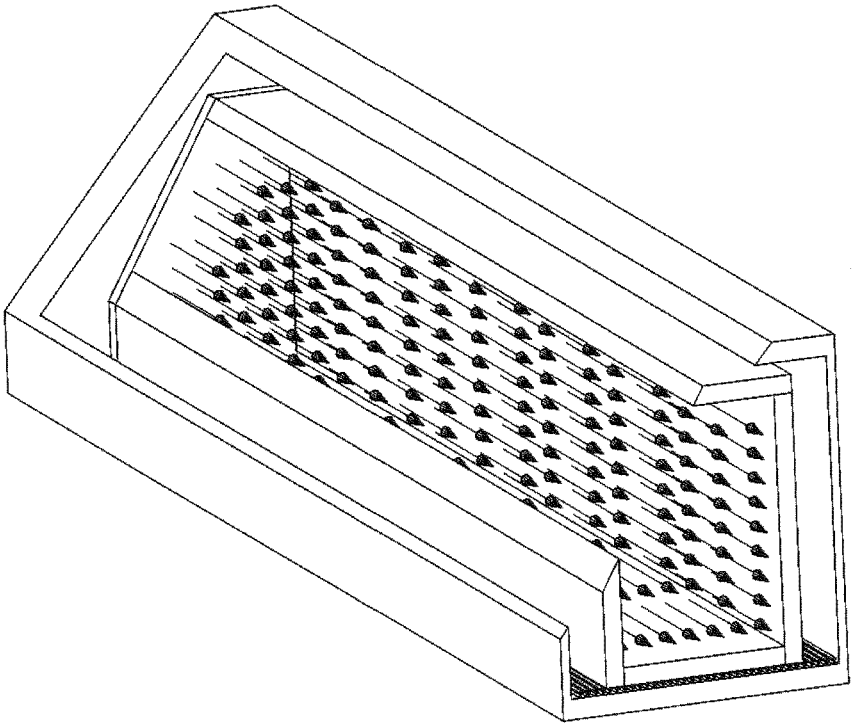
FIG. 2B shows how the air is moved inside the secondary chamber using, for example, fans/blowers as the primary air movers.
Figure 3A:
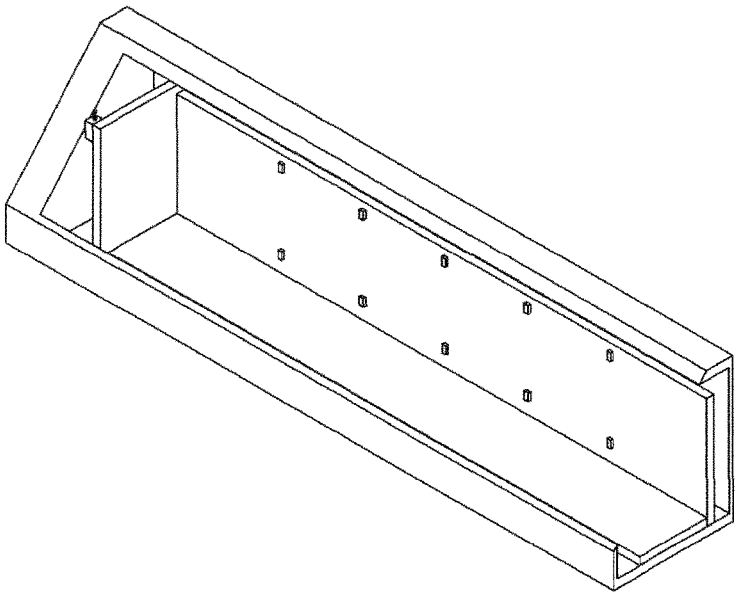
FIGS. 3A and 3B show the installation of the temperature monitoring system in an embodiment of the subject invention.
Figure 3B:
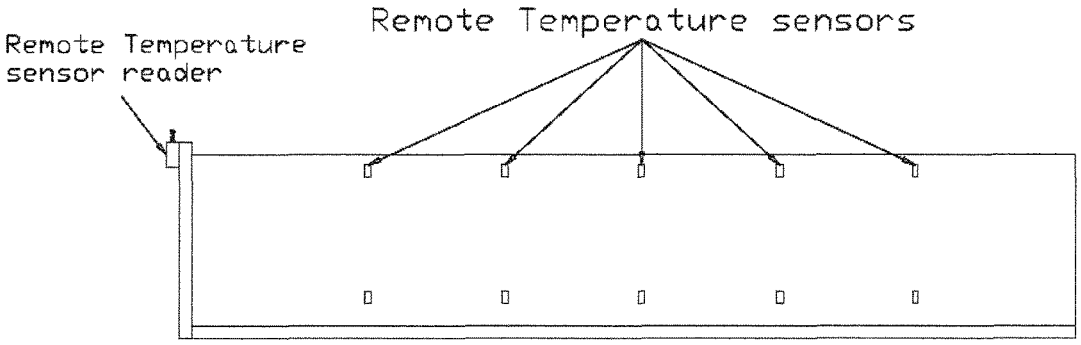
Figure 4A:
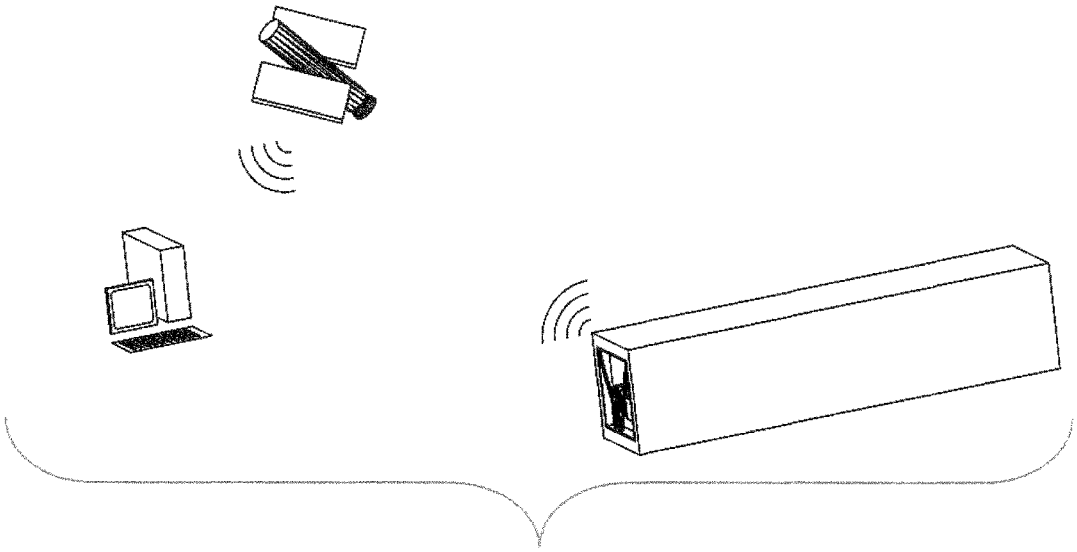
FIG. 4A shows the use of a communication system on the trailer/sea container communicating to the client's computer via satellite communication in accordance with an embodiment of the subject invention.
Figure 4B:
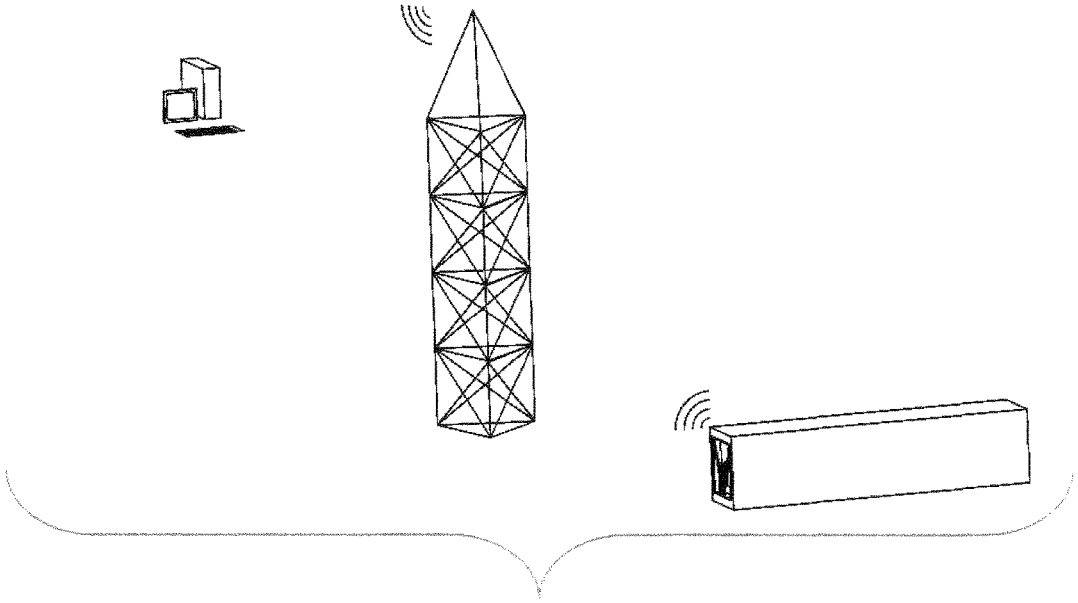
FIG. 4B shows the use of a communication system on the trailer/sea container communicating to the client's computer via a cell phone (GSM) land network in accordance with an embodiment of the subject invention.
Figure 5:
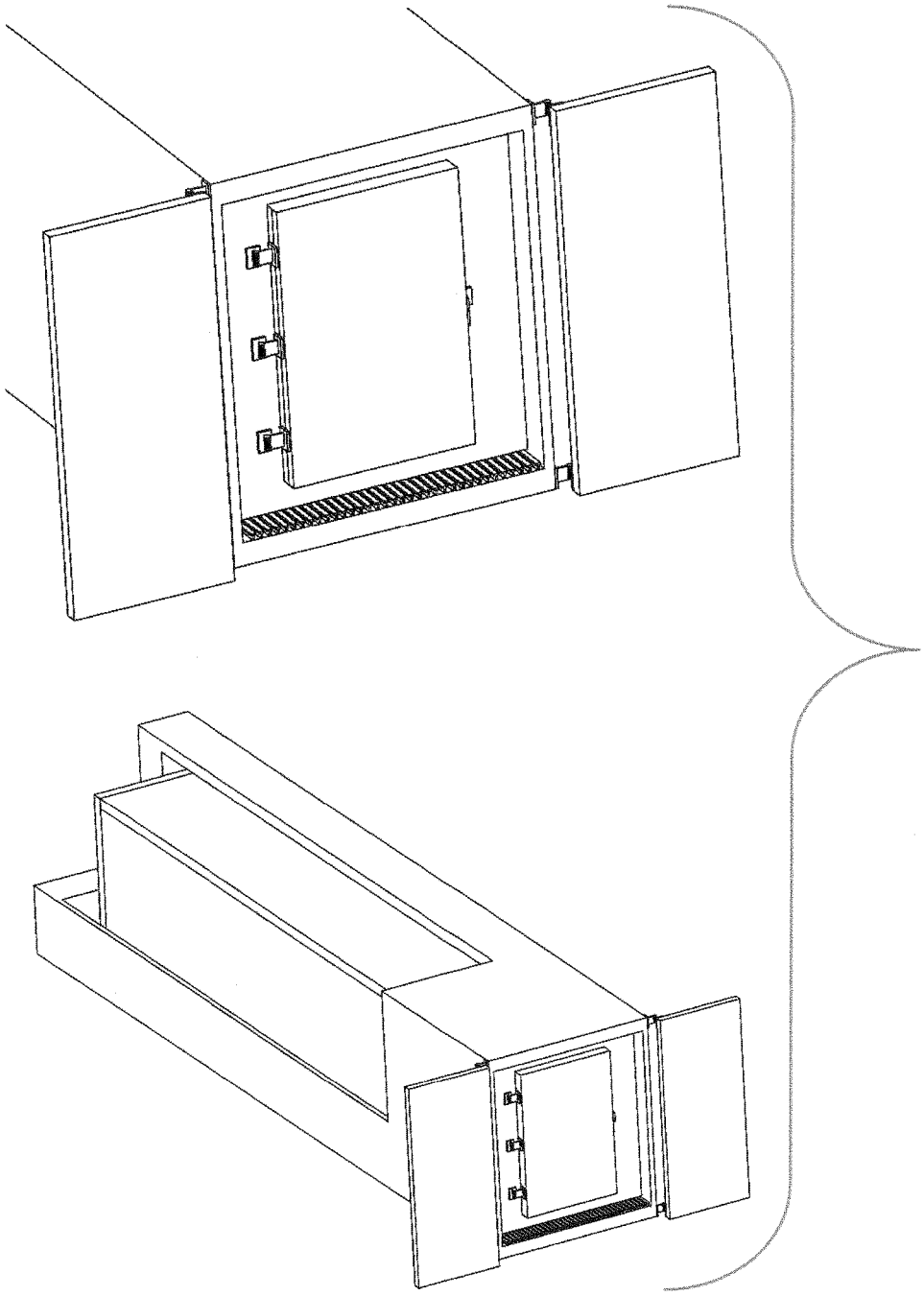
FIG. 5 shows an embodiment that has a secondary door for protection of the load during loading and unloading.

In accordance with an embodiment, once the refrigeration unit of the trailer or sea container is turned off or unplugged, for example, upon arrival at a destination to be loaded or unloaded, during transport in the case of a trailer being transferred from truck to truck, upon a malfunction in the refrigeration unit, in the case of a sea container being transported from the truck to the ship, vice versa, and/or upon a malfunctioning refrigeration unit, the transported materials can be kept at, or near, the set point temperature for a period of many hours, or days, depending on outside conditions. Upon the powering down of the refrigeration unit of the trailer or sea container, referring to FIG. 1, all circulation of air can be ceased inside and outside the secondary chamber 1 in the air gap 3. There are one or more circumstances during which the shutdown of the refrigeration unit can occur. A first circumstance is that the refrigeration unit has been running for a while and as a result, a temperature equilibrium exists between the inside of the secondary chamber and the air gap. In this situation, nothing mechanical occurs to the secondary chamber. A second circumstance is that the refrigeration unit was running after just being powered on for initial cooling of the loaded product inside the secondary chamber, such that a significant amount of refrigerated air is being introduced to the products within the secondary chamber for initial cooling and at the instant of the refrigeration unit's shutdown. In this situation, the secondary chamber is mechanically isolated from the trailer or sea container and the air gap 3. Once the secondary chamber is isolated from the trailer or sea container, there is no exchange of fluids, gasses, or solids in or out of the secondary chamber 1.

While the refrigeration unit is powered off, the only phenomenon occurring inside the trailer or sea container is the transfer of heat due to ambient outside and the trailer or sea container internal conditions. There are two likely conditions and one unlikely condition to occur during the period that the refrigeration unit is off, the two likely conditions to occur are that the ambient temperature can be higher or lower than the temperature inside the trailer or sea container and the third, and usually unlikely situation, is that the ambient temperature and the temperature inside the trailer or sea container are the same. The results of these circumstances yield a transfer of heat into the trailer or sea container when the ambient temperature is higher than the temperature inside the trailer or sea container, a transfer of heat out of the trailer or sea container when the ambient temperature is lower than that of the inside of the trailer or sea container, and a transfer of no heat when both the ambient and the inner temperature of the trailer or sea container are the same.

When heat is transferred into the container from the outside, such heat transfer typically utilizes three modes of heat transfer, radiation, conduction and convection. First, the trailer or sea container absorbs heat from the sun or any neighboring object emitting heat by radiation. Then, the heat is transferred through the walls of the trailer or sea container, or primary structure, through conduction. Finally, the heat that exists on the inner wall of the trailer or sea container, or primary structure, is transferred to the still air in the air gap 3 by convection. This air gap 3 acts as a heat transfer buffer to the secondary chamber. The size of the air gap lends itself as a perfect buffer for heat transfer due to the fact that the convective currents that form in the still air gap begin warming up rather slowly and will need to completely warm up a significant amount before they start to convectively transfer heat to the outer wall of the secondary chamber. Once the heat has been transferred to the outer wall of the secondary structure forming the secondary chamber, the heat will need to conduct itself through the various insulating materials that make up the walls, or secondary structure, of the secondary chamber so that it can finally transfer itself by convection and forming convection currents to the boxes of the loaded products.

In the case for when heat is transferred out of the container, the heat is transferred through the same three modes of heat transfer, in a reverse order. When the ambient outside temperature is colder than the temperature inside the container, heat will first be lost through the outer walls of the trailer or sea container by means of radiation and convection. Once the temperature of the outer walls of the trailer or sea container begins to drop, heat is transferred from the inner walls of the trailer or sea container by conduction to the outer walls. As the inner walls of the trailer or sea container begin to cool, a convective current is slowly formed in the air gap, which once again acts as a temperature, or heat transfer, buffer for the secondary chamber, such that the inner walls of the trailer will eventually start to retrieve heat from the outer walls of the secondary chamber. The reduction of heat on the outer walls of the secondary chamber will trigger a conductive heat transfer through each section and material that constitutes the entire wall sections of the secondary chamber. When the inner walls of the secondary chamber begin to lose their original temperature, they will begin to obtain heat from the air space inside the secondary chamber through convection, which will also result in the formation of a cooling convective current around and though the boxes of the loaded products. Once there exists a convective cooling current inside the secondary chamber, the products will lose their thermal capacity to maintain their proper temperature.

The previously mentioned temperature buffer created by the air gap 3 aids thermal protection greatly by decreasing the magnitude of the temperature gradient between the inside of the secondary chamber and the outside ambient conditions. In all cases, the time gained by the buffer and the walls of the secondary chamber should be more than adequate length to preserve the transported product's constant, or near constant, temperature, so when the refrigeration unit is restarted once again, the air will only need to be re-circulated and conditioned/heated in the air gap and not the secondary chamber.

In an embodiment, both the roof and the floor of the secondary chamber are also encompassed by the buffering air gap, although differing details exist between the floor of the secondary chamber and the inner floor of the trailer or sea container. The structural system that exists between the floor of the secondary chamber and the floor of the trailer or sea container contains properties that are favorable in acting as both a series of partitioning channels and as a thermodynamic heat sink/source. When the refrigeration unit is being used in cooling/freeze mode, the structure system is utilized as a heat sink and will maintain a cold temperature for a long time after an immediate shutdown of the refrigeration unit, which will aid in maintaining a cooler air gap temperature and help in resisting the formation of heating convective currents in the air gap. When the refrigeration unit is used in heat mode and experiences an immediate shutdown, the structure system lends itself as a heat source and helps maintain a warm air gap and helps to slow the formation of cooling convective currents in the air gap. Specific embodiments can share the roof and/or the floor, and/or one or more walls, between the primary structure and the secondary structure.

Product loading of the secondary chamber may be achieved via multiple integrated loading systems. Loading systems of many types including both self propelled (powered) or manual (non-powered) systems may be used for the loading and unloading of products inside the secondary chamber. Examples of self propelled systems that can be used as modes of automated pallet loaders in accordance with embodiments of the invention include: systems such as pneumatic conveyors, single and double row belt conveyors, and roller conveyor systems. These automatic systems may be or may not be used in conjunction with the use of a driven forklift or manual pallet handler. Upon the loading of a pallet onto the loading system, the pallet makes its way to its proper location inside the secondary chamber. These powered loading systems may either be powered by their own individual power supplies or may harness power from the trailer's or sea container's power system/source. Suitable manual loading systems comprise of gravity fed roller panels, individual guided pallet railed systems, and roller ball bed systems. A manually fed and operated system, with or without an integrated breaking system, may be operated in cooperation with a driven forklift or manual pallet handler. To ease the loading period, the temporary placement and use of an extended roller panel protruding out the door of the secondary chamber may be added. Each pallet is loaded into the secondary chamber to its proper location to maintain even temperature distribution and a high degree of isolation from harsh environmental circumstances. Conventional loading is also possible via a hydraulic pallet jack and a centering system for the maximization of even air flow.

In order to maintain a proper amount of cooling or heating convective currents while the secondary chamber is being used for preliminary cooling or heating of the air, preferably adequate equal space is provided on all sides of the loaded pallets. Types of guiding or railed bumper systems can be built into each loading system. This guiding system can also ensure that when the pallets are loaded, they are loaded in the proper direction and are unable to rotate and collide with any installed devices along the inner walls of the secondary chamber. As the trailer or sea container system can be used for international transport, this pallet guiding system can be adaptable for various sizes and types of pallets. The guide rails preferably do not hinder the ease and flexibility of loading. Such a guiding system may be as basic and simple as two rails mounted to or near the integrated loading system, or as complex as an automatic adjusting system that adjusts itself at a touch of a button for the desired loaded pallet size. However, the design of the guide rail/bumper system, regardless of its complexity, can allow for proper even air flow between the loaded products and the inner walls of the secondary chamber, including the gap between the first pallet and the back wall and also the last pallet and the inner wall of the secondary chamber door.

Once loaded into the secondary chamber, the loaded pallets can be quickly secured and braced inside the secondary chamber to preserve the quality of the products and to enhance an even heating or cooling convective current surrounding the products when needed. The bracing system used can be engineered so that the most delicate products' integrity is not compromised, yet the system is robust enough to secure a palletized load weighing up to 1000 pounds (454 Kg) or more. The bracing of the products can either be accomplished by bracing each pallet one by one as it is loaded into the secondary chamber or alternatively all the palletized loads may be sequentially loaded one after another and an automated bracing system that can conform to each palleted load and quickly secure it to minimize the move-ability of each load, while allowing maximum air distribution around each palleted load yielding a rather high convective form of heat transfer. A manual, powered or fully automated bracing system may be utilized via many different securing methods. Pallets may either be secured to the integrated manual or powered loading system, to the walls of the secondary chamber, or a combination of the walls and the loading system. Palletized loads can also be secured by means of a pneumatically operated securing system such as a system that compresses the load between inflatable devices.

Figure 8:
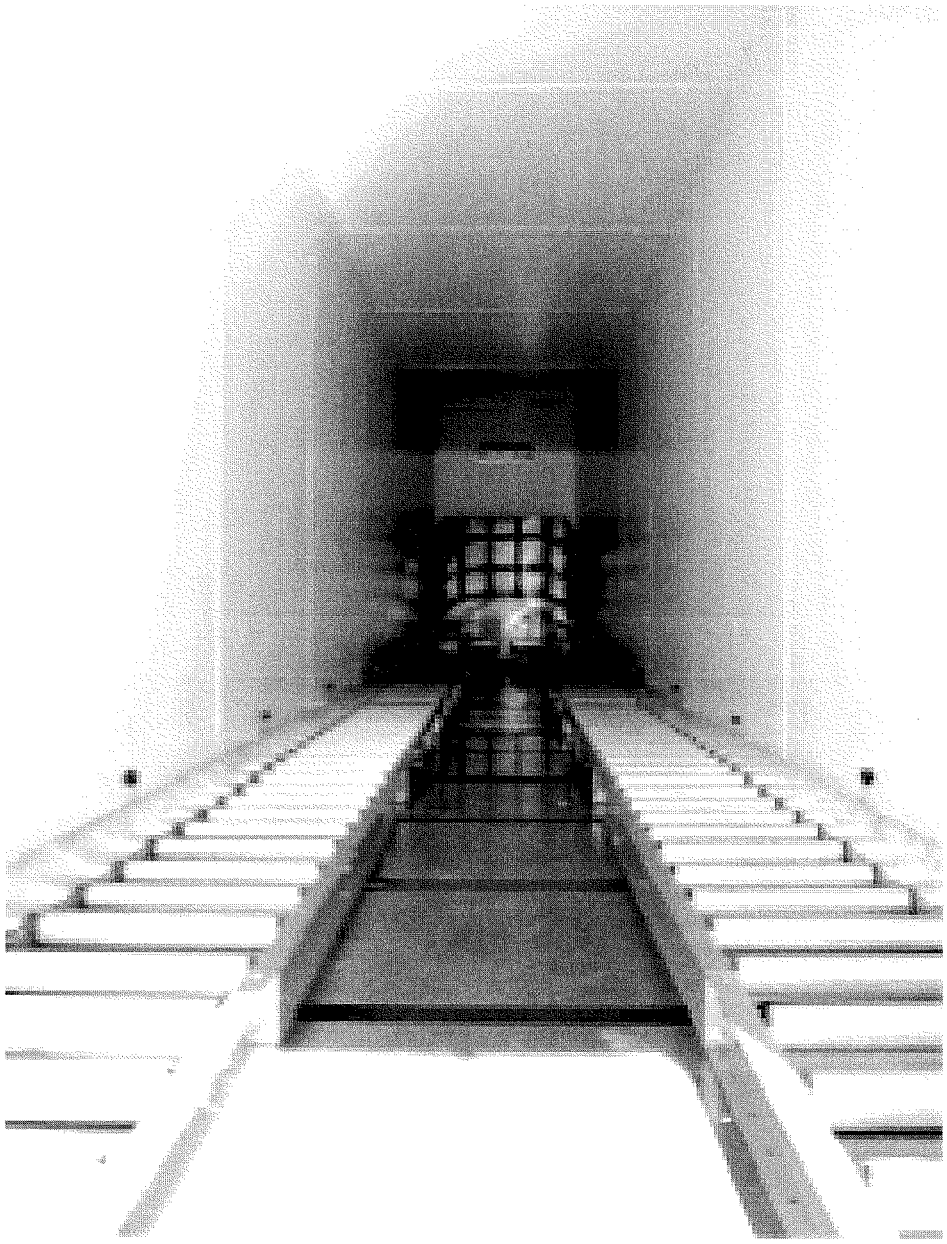
FIG. 8 shows the interior of an embodiment of a secondary chamber with a pallet skid system in the secondary chamber and a pallet on the skid system.
Figure 9:
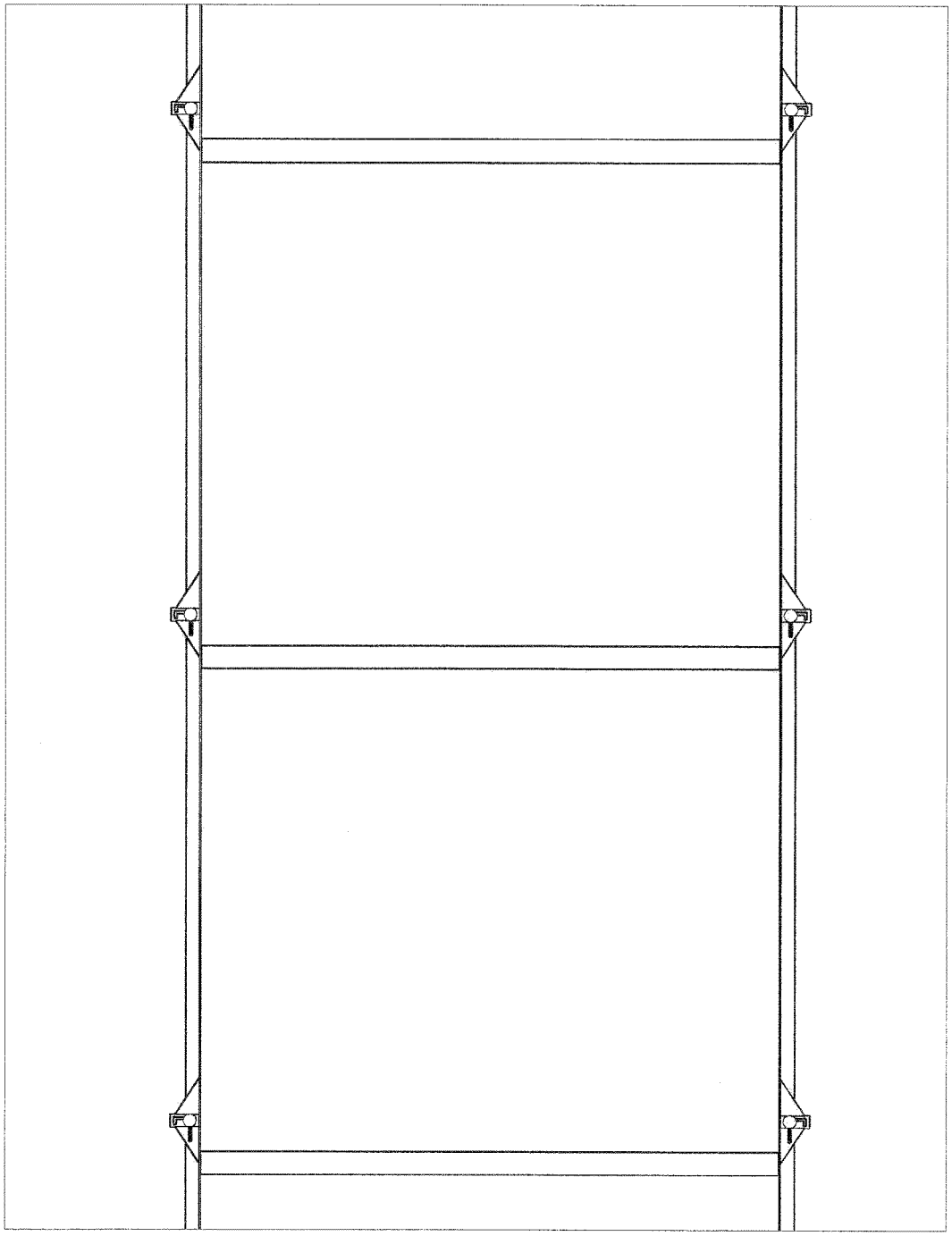
FIG. 9 shows a top view of a pallet conveyor system in accordance with an embodiment of the subject invention.
Figure 10:
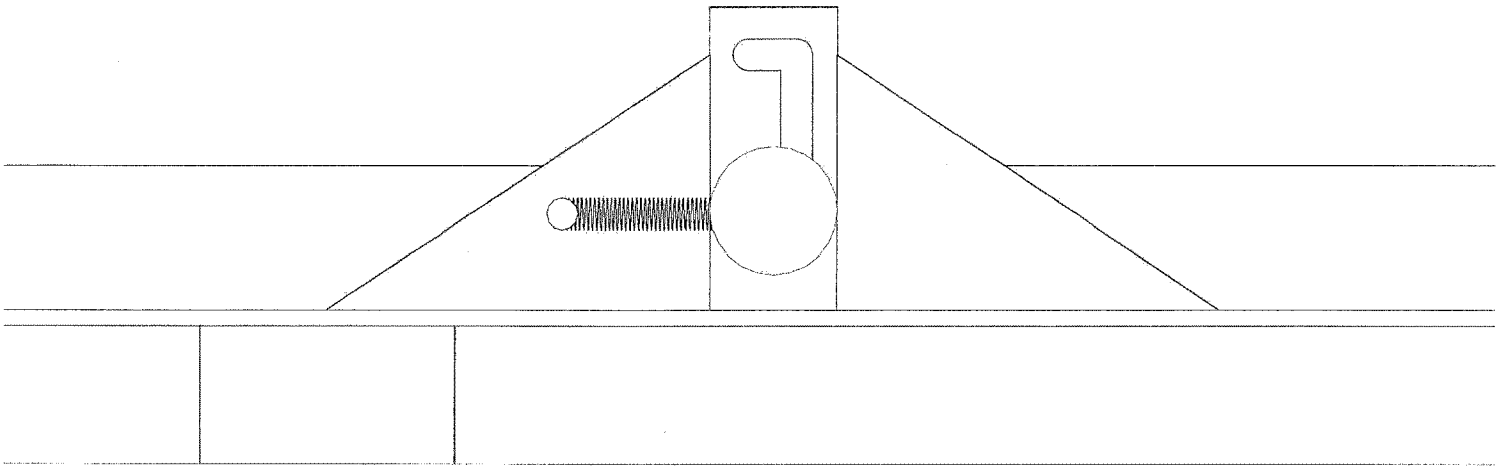
FIG. 10 shows a top view of a locking mechanism for a pallet conveyor system in accordance with an embodiment of the subject invention.
Figure 11:
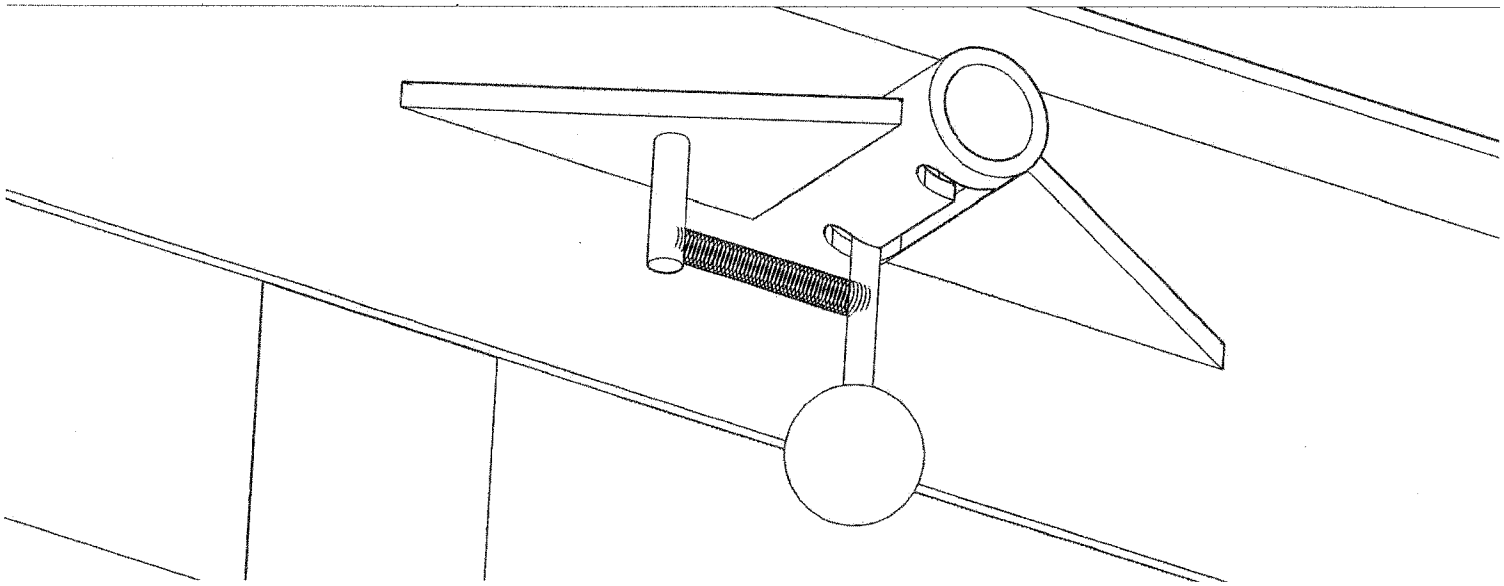
FIG. 11 shows a perspective view of a locking mechanism for a pallet conveyor system in accordance with an embodiment of the subject invention.
Figure 12:
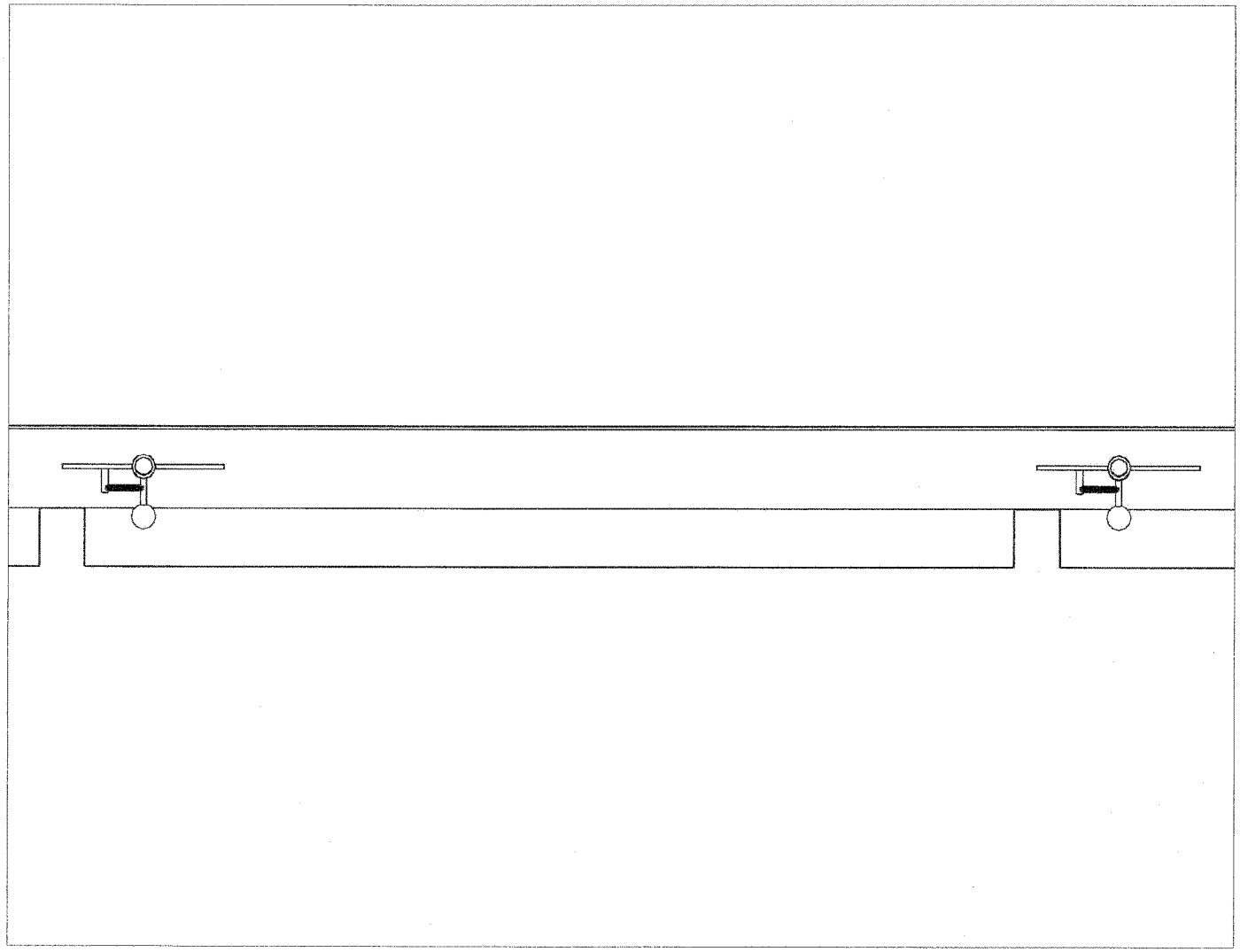
FIG. 12 shows a side view of a pallet convey system in accordance with an embodiment of the subject invention.
Figure 13:
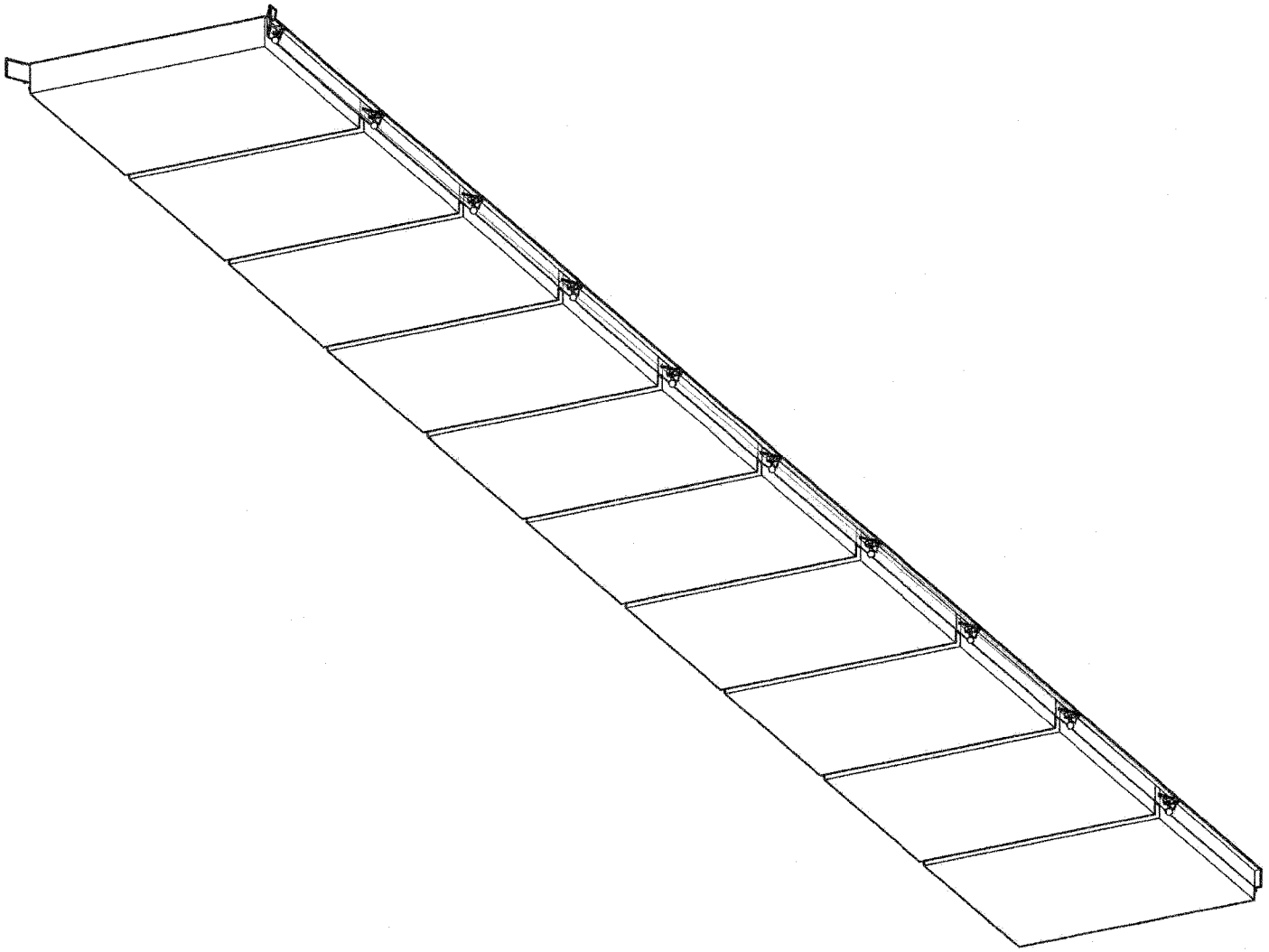
FIG. 13 shows a perspective view of a pallet conveyor system in accordance with an embodiment of the subject invention.
Figure 14:
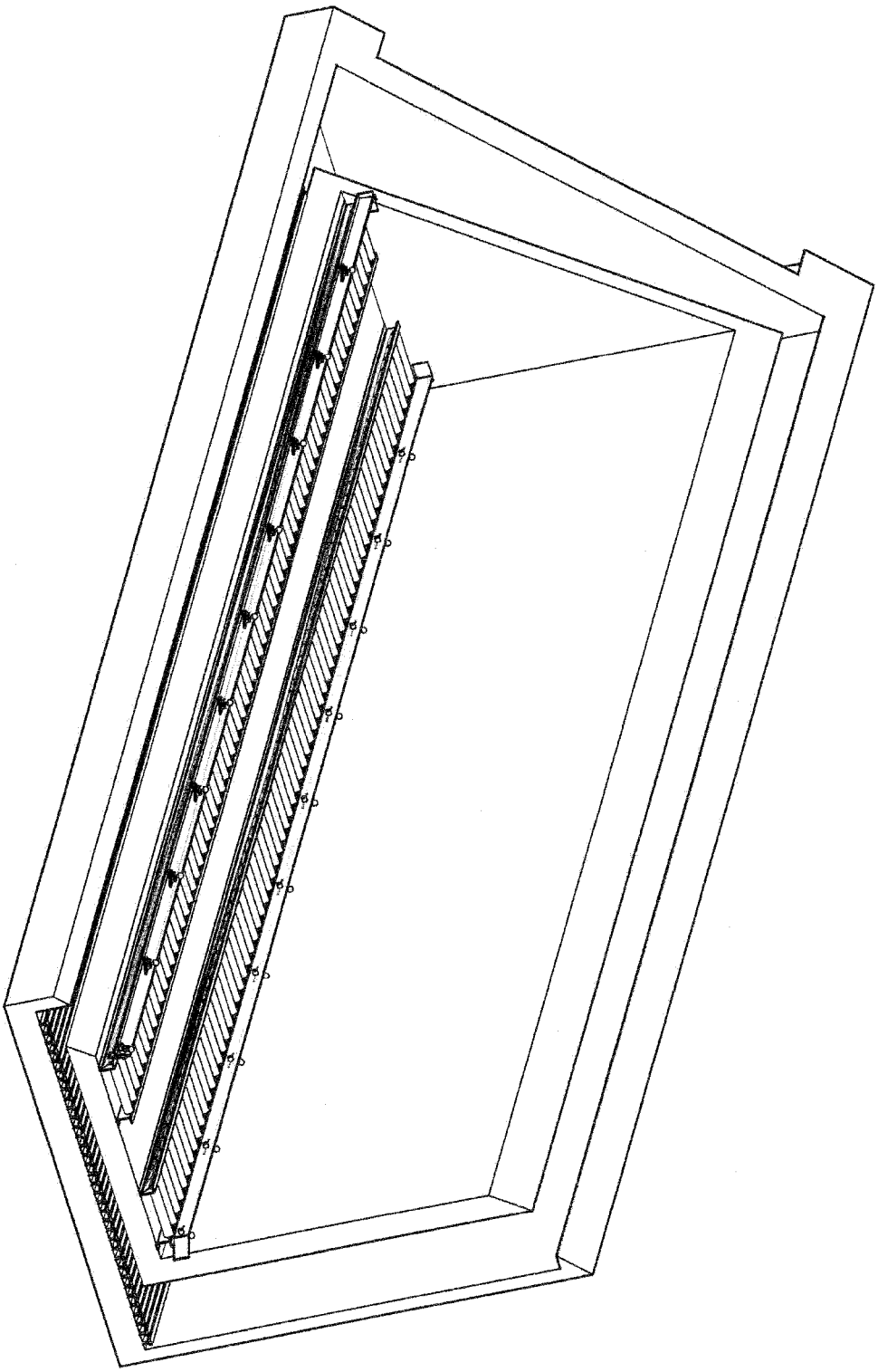
FIG. 14 shows a cut away view of an embodiment having a secondary structure inside of a primary structure with a gap between the secondary structure and the primary structure and two pallet skid structures for moving pallets along the floor of the secondary chamber.
Figure 15:
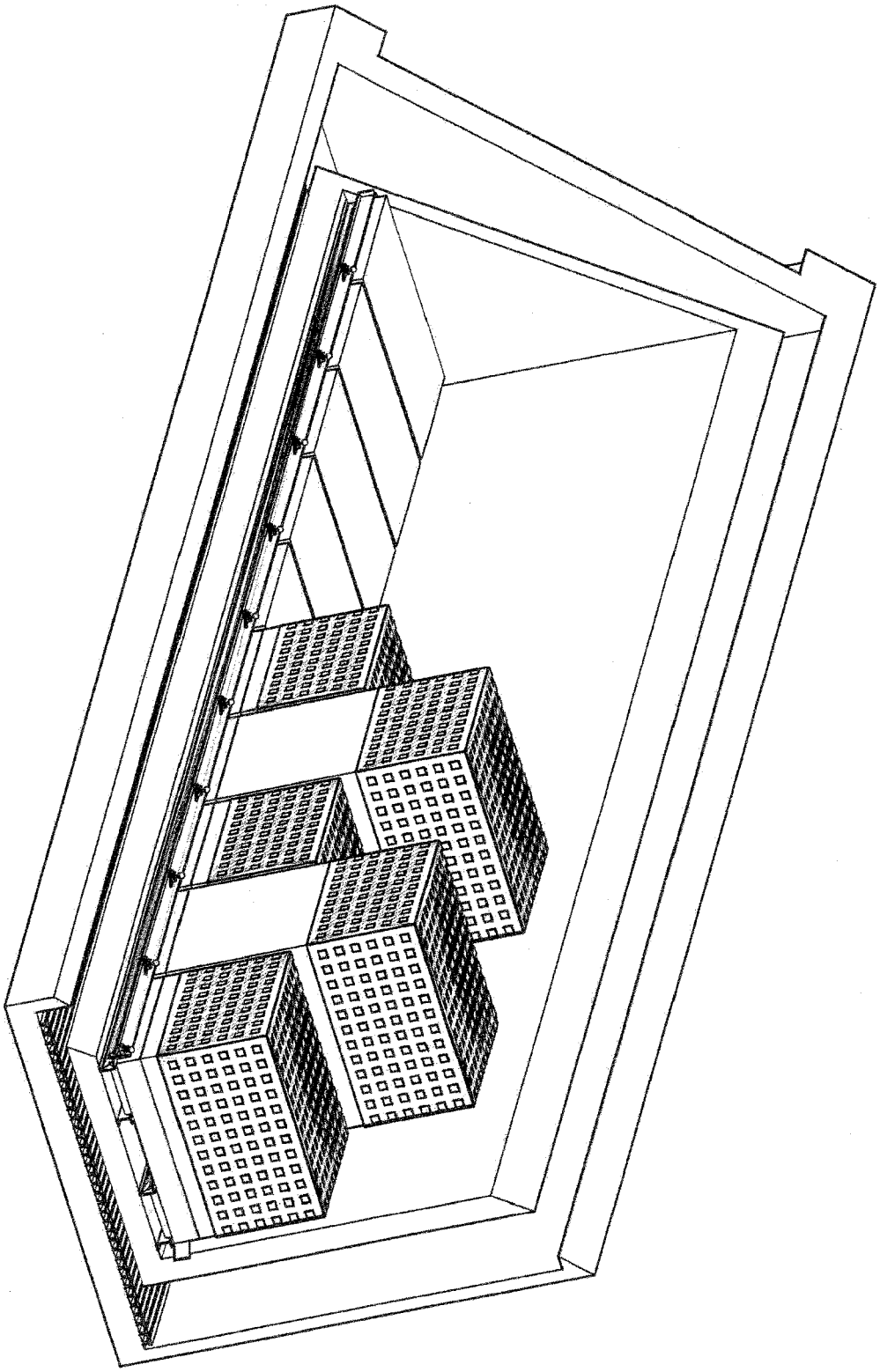
FIG. 15 shows the embodiment of FIG. 14 with pallets in five of the pallet platforms.

Referring to FIGS. 9-15, various views of a pallet, or other cargo, loading system is shown. The pallets can sit on top of the loading platforms that are then locked into place after the pallet is in position along the channels. Once locked down, the pallet is secured in place and does not damage the walls of the secondary structure. The cargo on the pallets can be tied down by nets, as shown in FIGS. 8 and 15, or by other securing means. The channel of the pallet loading system can be secured to the secondary floor to secure the load in place.

In an embodiment, the air distribution system in the trailer or sea container can be modified in a balanced manner in order to obtain optimum usage and performance of the secondary chamber in terms of initial heat transfer and prolonged temperature uniformity. When running at its user defined set operating temperature, the air inside the secondary chamber as well as the air in the trailer or sea container is directed where needed in order to maintain the most uniform product temperature. Once the entire interior of the secondary chamber has reached the set point temperature, which indicates that the loaded products and air temperature have reached the same temperature and the heat transfer rate is zero, a second operating regime may be implemented, in which the conditioned air is bypassed away from the secondary chamber and is fully circulated in the air gap. After the bypass of conditioned air away from the secondary chamber, the secondary chamber can be completely sealed from the air gap preventing the products from any heat gains or losses to or from the air gap. The recirculation of air in the air gap serves as a barrier which does not allow, or greatly reduces, heat transfer between the still aired secondary chamber and the environment outside the trailer or sea container. This air circulation modeled process depicts the phenomena of steady state no heat generation/heat loss when a non heat generating load is placed inside the secondary chamber, while a fresh supply of conditioned air is supplied in the air gap. The driving mechanisms for an air distribution of this magnitude can either be integrated into the trailer's or sea container's refrigeration system or may be its own stand alone system integrated into the secondary chamber. An air driving and directing system can include a system of ducts alone, or may include a system of ducts combined with baffles and incorporate various types of air movers such as blowers or fans (which can be part of primary refrigeration system or added in conjunction to the primary air circulating system of the trailer or sea container). If dealing with frozen or refrigerated products, the ventilation system can eliminate the harsh temperature rise caused by the trailer's or sea container's automatic or manually set defrost cycle.

In an embodiment, a lighting system can be incorporated into the secondary chamber to ensure a safe and quick loading of the temperature sensitive products. This lighting system can use as little power as possible to generate as little heat as possible in the secondary chamber. The lighting system may be installed anywhere in the secondary chamber to ensure total adequate lighting is achieved. In an embodiment, this lighting system can also be mounted outside the secondary chamber or brought in as a portable rechargeable system. Applicable systems to this type of application include, for example, fluorescent lights, LED lights, and low voltage neon lights.

The secondary chamber can be structured and secured to the trailer/sea container in various ways. From the ground up, a securing system for securing the secondary chamber can begin with anchoring the chamber to the floor of the trailer/sea container via various methods. Once a secure anchor is established, the walls and roof are supported to the walls, roof or combination of both to secure from lateral and vertical strains caused by mishandling of loaded products and externally induced shocks. The method used to laterally and vertically restrain and secure the secondary chamber in place may include a system of jack type bars that apply forces between the outer walls of the secondary chamber and inner walls of the trailer or sea container, nearly compressing the secondary chamber inside the trailer or sea container.

The whole integrated chamber system, as well as the trailer or sea container, can receive and/or communicate several very important packets of information to and/or from the user. Beginning in the secondary chamber, various types of data can be collected via an integrated or non integrated wired or wireless monitoring system. This monitoring system can also communicate with sensors placed inside the user's products for the retrieval of real time detrimental product information. Sensors can be placed in the air gap and may either communicate with the same monitoring system monitoring the secondary chamber or another trailer or sea container integrated or non integrated monitoring system. Audio, video and imaging data may also be communicated by the monitoring system. Integrated system monitoring sensors of the trailer's or sea container's refrigeration unit as well as real time system status information and alarms are also retrieved by a trailer or sea container integrated or non integrated monitoring system.

All of the monitored information of the secondary chamber and trailer or sea container, as well as container and secondary chamber door positions, can be communicated to the user. Real time GPS information, as well as the monitoring system information, can be communicated to the user via various methods of communication for a source of real time communication. A combination of GSM network communication and satellite communication are a good example. While the trailer or sea container is in range of a GSM network, communication may occur over this type of network and when the trailer or sea container is out of GSM network range satellite communication may be used in order for the information to reach the end user as quick as possible. All monitoring and communication equipment may be placed on a power backup system for continuous real time data communication with the user. All the information can be sent or received by the user through different modes of communication such as, but not limited to, computer, internet, phone, text message, and/or fax. For some applications, software can receive the information and generate alarms or reports of different natures for the users and make actions such as changing setting on the trailer or sea container.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. A transportation container, comprising:

a primary chamber;

a primary door, wherein the primary door opens to provide access into the primary chamber from outside the transportation container;

a secondary chamber, wherein the secondary chamber is configured to hold a load to be transported;

a secondary door, wherein the secondary chamber is enclosed within the primary chamber when the secondary door is closed and the primary door is closed, wherein the secondary door opens to provide access into the secondary chamber from the primary chamber;

wherein the primary chamber is formed by a primary structure, wherein the primary structure comprises a primary floor, a primary roof, four primary walls, and the primary door, wherein the secondary chamber is formed by a secondary structure, wherein the secondary structure comprises the secondary door, a secondary floor, a secondary roof, and four secondary walls, wherein three primary walls of the four primary walls are separate from a corresponding three secondary walls of the four secondary walls, wherein the primary roof is separate from the secondary roof, and wherein a gap is formed between the primary roof and the secondary roof and between the three primary walls and the three secondary walls;

a primary passageway, wherein a primary fluid is supplied to the gap via the primary passageway, and wherein the primary fluid is air conditioned air; and a secondary passageway, wherein a secondary fluid is supplied to the secondary chamber via the secondary passageway, wherein the secondary fluid is air conditioned air, wherein the primary chamber is formed by the primary floor, the primary roof, the four primary walls, and the primary door, wherein the secondary chamber is formed by the secondary floor, the secondary roof, the four secondary walls, and the secondary door, wherein a fourth primary wall of the four primary walls is separate from a fourth secondary wall of the four secondary walls, such that the four primary walls are separate from the four secondary walls, wherein the gap is formed between the four secondary walls and the four primary walls, wherein the primary floor is separate from the secondary floor, wherein the gap is also formed between the secondary floor and the primary floor, and wherein the transportation container is configured such that the secondary chamber is selectively isolatable such that there is no exchange of fluids, gases, or solids into or out of the secondary chamber.

2. The transportation container according to claim 1, further comprising:

an air conditioner, wherein the air conditioner supplies the air conditioned air to the gap through the primary passageway and to the secondary chamber through the secondary passageway.

3. The transportation container according to claim 1, wherein one of the four secondary walls in combination with the secondary door separate the primary chamber into a first portion and a second portion, wherein the secondary door opens to provide access into the secondary chamber from the second portion, and wherein the primary door opens to provide access to the second portion from outside the transportation container.

4. The transportation container according to claim 1, wherein the air conditioned air maintains the secondary chamber at a desired temperature.

5. The transportation container according to claim 1, wherein the primary fluid slows down heat transfer from the secondary chamber to outside of the transportation container.

6. A transportation system, comprising:

the transportation container of claim 1; and refrigeration equipment, wherein the refrigeration equipment is configured to supply air conditioned air to the gap via the primary passageway and to supply air conditioned air to the secondary chamber via the secondary passageway.

7. The transportation container according to claim 1, wherein the transportation container provides thermal protection of a load positioned within the secondary chamber from conductive, convective, and radiation heat transfer through the four primary walls, the four secondary walls, the primary roof, the secondary roof, the primary floor, and the secondary floor.

8. The transportation container according to claim 1, further comprising:

a temperature control system, wherein the temperature control system controls a secondary chamber temperature inside the secondary chamber and a gap temperature in the gap depending on a desired temperature cycle set by a user.

9. The transportation container according to claim 1, further comprising:

a temperature monitor system, wherein the temperature monitor system monitors a secondary chamber temperature inside the secondary chamber.

10. The transportation container according to claim 1, further comprising:

a temperature monitor system, wherein the temperature monitor system monitors temperatures of products inside the secondary chamber.

11. The transportation container according to claim 1, further comprising:

a refrigeration unit; and a temperature information system, wherein the temperature information system transmits and receives information relating to a secondary chamber temperature inside the secondary chamber, a location of the transportation container, primary door openings, secondary door openings, and/or a state of the refrigeration unit.

12. The transportation container according to claim 1, further comprising:

a door monitor system, wherein the door monitor system monitors opening of the primary door and/or opening of the secondary door.

13. The transportation container according to claim 1, further comprising:

a loading system, wherein the loading system is utilized to load products into the secondary chamber and unload products from the secondary chamber.

14. The transportation container according to claim 1, further comprising:

a lighting system, wherein the lighting system provides light inside the secondary chamber.

15. The transportation container according to claim 1, further comprising:

a bracing system, wherein the bracing system secures products inside the secondary chamber.

16. The transportation container according to claim 1, further comprising:

a refrigeration unit; and a refrigeration unit control system, wherein the refrigeration unit control system monitors the refrigeration unit and is configured to physically or remotely reprogram the refrigeration unit and operating parameters of the refrigeration unit.

17. The transportation container according to claim 1, further comprising:

a first relative humidity monitor, wherein the first relative humidity monitor monitors a gap relative humidity inside the gap; and a second relative humidity monitor, wherein the second relative humidity monitor monitors a secondary chamber relative humidity inside the secondary chamber.

18. The transportation container according to claim 1, further comprising:

a detector, wherein the detector monitors vibrations, impacts, and shocks that products are exposed to inside the secondary chamber and is configured to report detected vibrations, impacts, and shocks that products are exposed to inside the secondary chamber.

19. The transportation container according to claim 1, further comprising:

a vibration and shock absorbing system, wherein the vibration and shock absorbing system reduces vibrations and shocks that products inside the secondary chamber are exposed to.

20. The transportation container according to claim 1, further comprising:

a door monitor, wherein the door monitor monitors a state of the primary door and a state of the secondary door, wherein the state of the primary door is either opened or closed, and wherein the state of the secondary door is either opened or closed.

21. The transportation container according to claim 1, further comprising:

a communication system, wherein the communication system comprises:

a computer server; and an interface, and wherein the communication system is configured to transmit information to the computer server and allow users to access the information through the interface.

22. The transportation container according to claim 1, further comprising:

a camera, wherein the camera is configured to record images and/or transmit images of an inside of the secondary chamber.

23. The transportation container according to claim 1, further comprising:

a humidity control system, wherein the humidity control system controls a secondary chamber humidity inside the secondary chamber.

24. The transportation container according to claim 1, further comprising:

an alarm, wherein the alarm alerts a user when a loss of power to the transportation container occurs.

25. The transportation container according to claim 1, wherein the secondary door comprises a door heater, and wherein the door heater is configured to heat the secondary door.

26. The transportation container according to claim 1, wherein the gap between the four secondary walls and the four primary walls is 1-18 inches thick.

27. The transportation container according to claim 1, wherein the gap between the four secondary walls and the four primary walls is 12-18 inches thick.

28. The transportation container according to claim 1, wherein the gap between the four secondary walls and the four primary walls is greater than 1 inch thick.

29. The transportation container according to claim 1, wherein the transportation container is configured such that when the secondary chamber is selectively isolated such that there is no exchange of fluids, gases, or solids into or out of the secondary chamber, air conditioned air is bypassed away from the secondary chamber and air in the gap is circulated.

30. The transportation container according to claim 29, wherein when the secondary chamber is selectively isolated such that there is no exchange of fluids, gases, or solids into or out of the secondary chamber, air conditioned air is bypassed away from the secondary chamber, air in the gap is circulated, and air conditioned air is supplied to the gap.

31. The transportation container according to claim 1, wherein the transportation container is configured to supply air conditioned air to the gap and supply air conditioned air to the secondary chamber while the gap is formed between the secondary floor and the primary floor.

32. A method of transporting a load, comprising:

providing the transportation container of claim 1;

loading a load in the secondary chamber; and transporting the transportation container from a first location to a second location, such that the load is transported from the first location to the second location.

33. The transportation container according to claim 1, wherein the gap formed between the secondary floor and the primary floor is formed with a series of partitioning channels.

34. The transportation container according to claim 1, wherein the transportation container comprises an exterior structure, wherein the exterior structure comprises an exterior floor, an exterior roof, four exterior walls, and an exterior door, such that when the exterior door is closed the exterior structure separates an interior of the transportation container and an exterior of the transportation container, and wherein the primary structure is the exterior structure.

35. The transportation container according to claim 34, wherein the secondary structure is pre-assembled and removably insertable into the primary chamber.

36. The transportation container according to claim 1, wherein the four secondary walls are thermally insulated.

37. The transportation container according to claim 1, wherein the secondary structure is fixedly attached to the primary structure.

38. The transportation container according to claim 1, wherein the transportation container is configured such that when:

(i) a load is loaded in the secondary chamber; and (ii) the transportation container is transported from a first location to a second location, the gap is formed between the four secondary walls and the four primary walls and between the secondary floor and the primary floor.

39. The transportation container according to claim 1, wherein the transportation container is configured such that the secondary fluid can be supplied to the secondary chamber via the secondary passageway at the same time the primary fluid is supplied to the gap via the primary passageway.

* * * * *